US007966848B2

(12) United States Patent
Jang et al.

(10) Patent No.: US 7,966,848 B2
(45) Date of Patent: Jun. 28, 2011

(54) WASHING MACHINE HAVING A DRAIN PUMP TO REDUCE VIBRATION

(75) Inventors: Jae Hyun Jang, Suwon-si (KR); Dong Bin Lim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1229 days.

(21) Appl. No.: 11/639,319

(22) Filed: Dec. 15, 2006

(65) Prior Publication Data

US 2007/0256458 A1 Nov. 8, 2007

(30) Foreign Application Priority Data

May 3, 2006 (KR) ..... 10-2006-0039973

(51) Int. Cl.
*D06F 37/20* (2006.01)

(52) U.S. Cl. ..... 68/18 F; 68/207

(58) Field of Classification Search ..... 68/18 F, 68/207

See application file for complete search history.

(56) References Cited

U.S. PATENT DOCUMENTS 2,277,885 A * 3/1942 Rodanet ..... 411/34
2,454,465 A * 11/1948 Leo et al. ..... 285/139.2
2,835,305 A * 5/1958 Boyer ..... 152/427
3,385,085 A * 5/1968 Engel ..... 68/18 F
3,423,518 A * 1/1969 Weagant ..... 174/153 G
3,486,523 A * 12/1969 Mullings ..... 137/271
3,871,796 A * 3/1975 Mack ..... 417/423.11
3,973,789 A * 8/1976 Kunz et al. ..... 285/39
4,057,269 A * 11/1977 Bislew ..... 285/136.1
4,179,038 A * 12/1979 Rosan, Jr. ..... 220/243
4,309,007 A * 1/1982 Logsdon ..... 248/56
4,905,940 A * 3/1990 Luka ..... 248/56
4,984,309 A * 1/1991 Lowry ..... 4/288
6,241,199 B1 * 6/2001 Ismert ..... 248/56
6,931,891 B2 * 8/2005 Killane ..... 68/3 R
6,938,627 B2 * 9/2005 Jung et al. ..... 134/104.2
7,073,520 B2 * 7/2006 Zanello et al. ..... 134/111
7,121,589 B2 * 10/2006 Hawkinson et al. ..... 285/139.2

(Continued)

FOREIGN PATENT DOCUMENTS

DE 38 02 890 * 8/1989

(Continued)

OTHER PUBLICATIONS

Chinese Office Action for corresponding Chinese Application 200610170052.9; issued Jan. 23, 2009.

*Primary Examiner* — Frankie L Stinson
(74) *Attorney, Agent, or Firm* — Staas & Halsey LLP

(57) ABSTRACT

A washing machine having a cabinet and a drain pump, which prevents the vibration of the drain pump from being transferred to the cabinet, and improves the efficiency in assembling the drain pump with the cabinet. In the washing machine having a cabinet forming an external portion of the washing machine and having a through hole defined through a portion of the cabinet and a drain pump installed on the cabinet, the drain pump includes a connection unit having one end passing through the through hole and protruding to an outside of the cabinet, an anti-vibration member affixed in the through hole to absorb the vibration of the drain pump, and a fixing member connected with the connection unit and pressing the anti-vibration member.

17 Claims, 7 Drawing Sheets

U.S. PATENT DOCUMENTS

2004/0108260 A1* 6/2004 Heo, II ..... 210/171

FOREIGN PATENT DOCUMENTS

DE 25 54 544 * 6/1997
DE 102004039436 2/2006
JP 2000-350896 * 12/2000
KR 0132865 9/1998
KR 2002046688 * 6/2002
KR 2006004130 * 1/2006

* cited by examiner

PRIOR ART

WASHING MACHINE HAVING A DRAIN PUMP TO REDUCE VIBRATION

CROSS-REFERENCE TO RELATED APPLICATIONS

This application claims the benefit of Korean Patent Application No. 2006-0039973, filed May 3, 2006, in the Korean Intellectual Property Office, the disclosure of which is incorporated herein by reference.

BACKGROUND OF THE INVENTION

1. Field of the Invention

The present invention relates to a washing machine, and more particularly, to a washing machine having a drain pump to reduce vibration.

2. Description of the Related Art

Generally, washing machines are apparatuses that wash laundry by rotating a cylindrical drum containing water and the laundry. The washing machines may be, for example, a drum washing machine and a vertical axis washing machine. In the drum washing machine, a drum is horizontally disposed so that laundry is raised along the inner circumferential surface of the drum and then dropped, so that the laundry is washed when the drum is rotated in regular and reverse directions against a horizontal shaft. In the vertical axis washing machine, a drum provided with a pulsator installed therein is vertically disposed so that laundry is washed by water currents generated from the rotation of the pulsator in regular and reverse directions.

A conventional washing machine includes a tub for containing water, a drum rotatably installed in the tub and provided with through holes formed through the circumferential surface thereof for dehydrating the laundry, and a driving device for driving the drum. The washing machine further generally includes a water supply device for supplying the water to the inside of the tub, and a drain pump for draining the water in the tub.

The drain pump is fixedly installed on the inner surface of the bottom of a cabinet by a support portion of the drain pump.

In the above conventional washing machine, the support portion of the drain pump is fixed directly to the bottom of the cabinet by a fixing bolt. Accordingly, the vibration of the drain pump is transferred to the outside of the drain pump through the bottom of the cabinet, thus causing vibration and noise. Therefore, when the washing machine is used for a long time, the support portion of the drain pump may become deformed, and the deformation of the drain pump causes noise of the washing machine.

In order to solve the above noise and vibration problems of the drain pump, Korean Utility Model Registration No. 0132865 discloses an apparatus for preventing vibration of a drain pump of a washing machine. The apparatus includes an anti-vibration member for preventing the vibration of the drain pump from being transferred to an external body, which is disposed between fixing pieces formed at both sides of the lower end of the drain pump and the external body. A through hole, into which a connection bolt is inserted, is formed through the center of the anti-vibration member, and grooves, into which fixing pieces are inserted, are formed in the outer circumferential surface of the upper end of the anti-vibration member.

The anti-vibration member of the above apparatus reduces the vibration of the drain pump. However, the anti-vibration member of the apparatus is assembled with the external body using the bolt, thus lowering efficiency in assembling the apparatus with the washing machine and increasing the production costs of the apparatus.

Further, the apparatus does not provide for fixedly installing the drain pump on a side surface of a cabinet of the washing machine. Moreover, the apparatus does not have a structure for preventing the vibration of the drain pump from being transferred to an external case of the washing machine.

FIG. 1 is a perspective view of a drain pump, in an assembled state, fixed to a side surface of a cabinet of a conventional washing machine.

In the conventional washing machine, as shown in FIG. 1, an inlet of a drain pump 2 is fixed to a front frame 1 using screws 3. Accordingly, the vibration of the drain pump 2 is transferred to the front frame 1, thus increasing the vibration and noise of the washing machine. Further, the connection using the screws 3 lowers the efficiency in assembling the drain pump 2 with the washing machine, thus increasing the production costs of the washing machine.

SUMMARY OF THE INVENTION

Therefore, one aspect of the invention is to provide a washing machine having a drain pump that prevents the vibration of the drain pump from being transferred to a cabinet and improves the efficiency in assembling the drain pump with the cabinet.

Additional aspects and/or advantages of the invention will be set forth in part in the description which follows and, in part, will be apparent from the description, or may be learned by practice of the invention.

The foregoing and/or other aspects are achieved by providing a washing machine having a cabinet forming an external portion of the washing machine and having a through hole defined through a portion of the cabinet, and a drain pump installed on the cabinet, and the drain pump includes a connection unit having one end passing through the through hole and protruding to outside of the cabinet, an anti-vibration member affixed in the through hole to absorb the vibration of the drain pump, and a fixing member connected with the connection unit and pressing the anti-vibration member.

A connection groove is formed in the anti-vibration member, fittingly affixing the anti-vibration member to the through hole.

A protruding portion is formed on the connection unit so that the drain pump is supported by an end of the anti-vibration member.

The anti-vibration member is pressed by the protruding portion and the fixing member.

The anti-vibration member has a ring shape and the through hole has a circular shape such that the anti-vibration member is fittingly affixed to the through hole.

A first screw thread is formed on an outer circumferential surface of the connection unit, and a second screw thread is formed on an inner circumferential surface of the fixing member and is engagable with the first screw thread.

The anti-vibration member includes fixing grooves formed on an inner circumferential surface of the anti-vibration member fixing the position of the drain pump when the drain pump is installed on the cabinet, and the connection unit includes fixing protrusions formed therein and connected to the fixing grooves.

Fixing portions formed on an outer circumferential surface of the anti-vibration member maintain the horizontal position of the drain pump and prevent the rotation of the anti-vibration member due to the rotation of the fixing member.

The drain pump further includes a drain filter to filter impurities contained in water supplied to the drain pump.

The drain filter is insertable into and removable out of the cabinet through the through hole.

A third screw thread is formed on an inner circumferential surface of the connection unit, and a fourth screw thread is formed on an outer circumferential surface of the drain filter and is engagable with the third screw thread, so that the drain pump and the drain filter are screw-connected.

The connection unit is formed on a lower portion of the drain pump.

A filter hole allowing the drain filter to be inserted into and removed from the cabinet is defined through the cabinet.

The foregoing and/or other aspects are achieved by providing a washing machine having a cabinet forming an external portion of the washing machine and having a through hole defined therethrough; and a drain pump installed on the cabinet, the drain pump including a connection unit provided with one end protruded to an outside of the cabinet, an anti-vibration member provided between the through hole and a portion of the connection unit to absorb the vibration of the drain pump, and a fixing member connectable to the connection unit to fix the drain pump to the cabinet.

The drain pump further includes a drain filter to filter impurities contained in water supplied to the drain pump. The through hole is formed through a front surface of the cabinet, and the drain filter is inserted into and removed from the cabinet through the through hole.

The through hole is formed through a lower surface of the cabinet, and a filter hole allowing the drain filter to be inserted into and removed from the cabinet is formed through the cabinet.

The foregoing and/or other aspects are achieved by providing a washing machine having a cabinet having a through hole defined therethrough; a drain pump installed on one surface of the cabinet and an anti-vibration member provided between a circumferential surface of the through hole and the drain pump to reduce vibration of the drain pump transferred to the cabinet when the drain pump is operated, wherein one end of the drain pump protrudes to an outside of the cabinet through the through hole.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
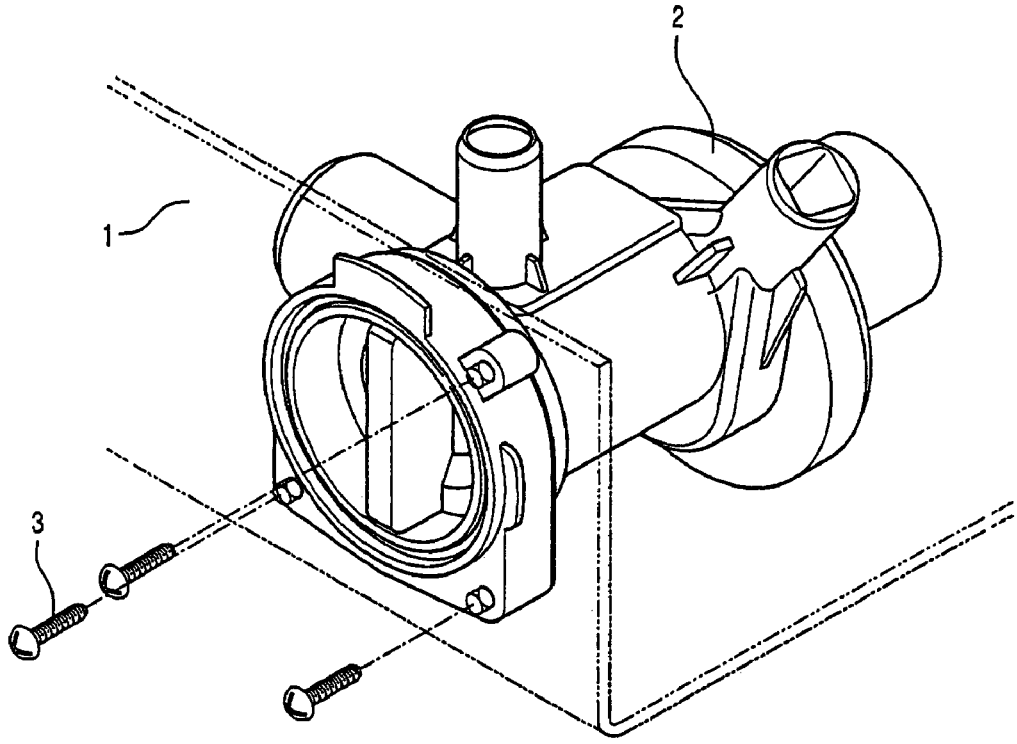
FIG. 1 is a perspective view of a drain pump, in an assembled state, fixed to a side surface of a case of a conventional washing machine.

Reference will now be made in detail to the embodiments of the present invention, examples of which are illustrated in the accompanying drawings, wherein like reference numerals refer to like elements throughout. The embodiments are described below to explain the present invention by referring to the annexed drawings.

The embodiments of the present invention may be applied to, for example, a vertical axis washing machine or a drum washing machine. Hereinafter, for the convenience of description, a drum washing machine will be described.

Figure 2:
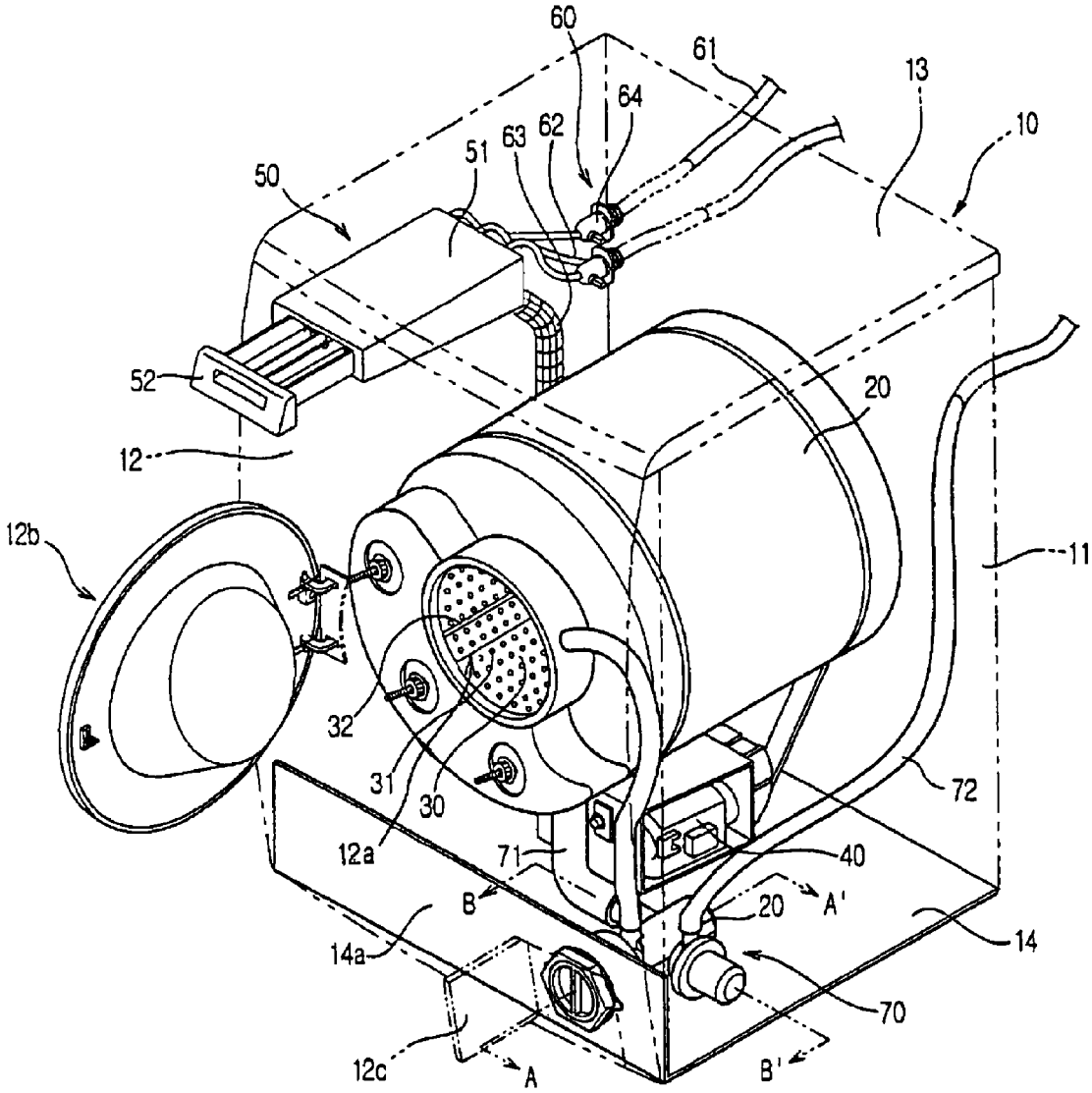
FIG. 2 is a schematic perspective view of a washing machine of according to a first embodiment of the present invention.

FIG. 2 is a schematic perspective view of a washing machine according to a first embodiment of the present invention.

As shown in FIG. 2, the washing machine of the first embodiment of the present invention includes a cabinet 10 forming an external portion of the washing machine, a cylindrical tub 20 installed in the cabinet 10 containing water for washing, a drum 30 rotatably installed in the tub 20, and a driving motor 40 installed below the tub 20 rotating the drum 30 installed in the tub 20. The washing machine further includes a detergent supply device 50 supplying detergent to the inside of the tub 20, a water supply device 60 installed above the tub 20 supplying water, into which the detergent from the detergent supply device 50 is dissolved, to the inside of the tub 20, and a drain pump 70 installed below the tub 20 to forcibly discharge the water from the inside of the tub 20 to the outside of the washing machine.

The cabinet 10 includes a main frame 11 having an internal space and provided with opened front, upper and bottom surface portions, a front frame 12 installed on the front surface portion of the main frame 11, a top cover 13 covering the upper surface portion of the main frame 11, and a lower frame 14 forming the bottom surface of the main frame 11.

The front frame 12 is provided with an opening 12*a* formed at a position thereof corresponding to openings of the tub 20 and the drum 30 so that laundry can be put into and taken out of the inside of the drum 30 through the opening 12*a*, and a door 12*b* to open and close the opening 12*a* is installed on the front frame 12. A filter door 12*c* to insert and remove a drain filter 130, which will be described later, into and out of the inside of the cabinet 10 is installed on a lower portion of the front frame 12.

The front end of the lower frame 14 is provided with a front portion 14*a*, which is vertically bent upwardly from the bottom surface of the main frame 11. A through hole 14*b* is formed through the front portion 14*a* of the lower frame 14. An anti-vibration member 150 absorbing the vibration of the drain pump 70 is connected to the through hole 14*b*. A connection unit 140 of the drain pump 70, which will be described later, passes through the through hole 14*b*, thus fixing the drain pump 70 to the lower frame 14.

A plurality of dehydration holes 31 are formed through the inner circumferential surface of the drum 30, and a plurality of lifters 32 lifting laundry from a lower portion of the drum 30 to an upper portion of the drum 30 are disposed on the inner circumferential surface of the drum 30 at a designated interval.

The detergent supply device 50 includes a detergent case 51 installed in the front surface of the cabinet 10, and a detergent container 52 installed on the front surface of the cabinet 10 such that the detergent container 52 may be drawn into and out of the detergent case 51. Thereby, a user first draws the detergent container 52 out of the detergent case 51, and then puts the detergent into the detergent container 52.

The water supply device 60 includes first water supply pipes 62, each of which is connected to corresponding external water supply pipes 61, connected to the rear surface of the detergent case 51, a second water supply pipe 63 connecting the detergent case 51 and the tub 20, and water supply valves 64, each of which is installed on the inlet-side portion of the corresponding first water supply pipes 62, controlling the water supply.

Accordingly, when water is supplied to the washing machine by opening the water supply valves 64, the supplied water is introduced into the tub 20 via the detergent supply device 50, thereby allowing the detergent put into the detergent supply device 50 to be supplied to the tub 20 together with the supplied water.

A first drain pipe 71 connects the tub 20 and the drain pump 70, and a second drain pipe 72 extends to the outside of the cabinet 10 to discharge the water from the drain pump 70 to the outside of the drain pump 70.

Figure 3:
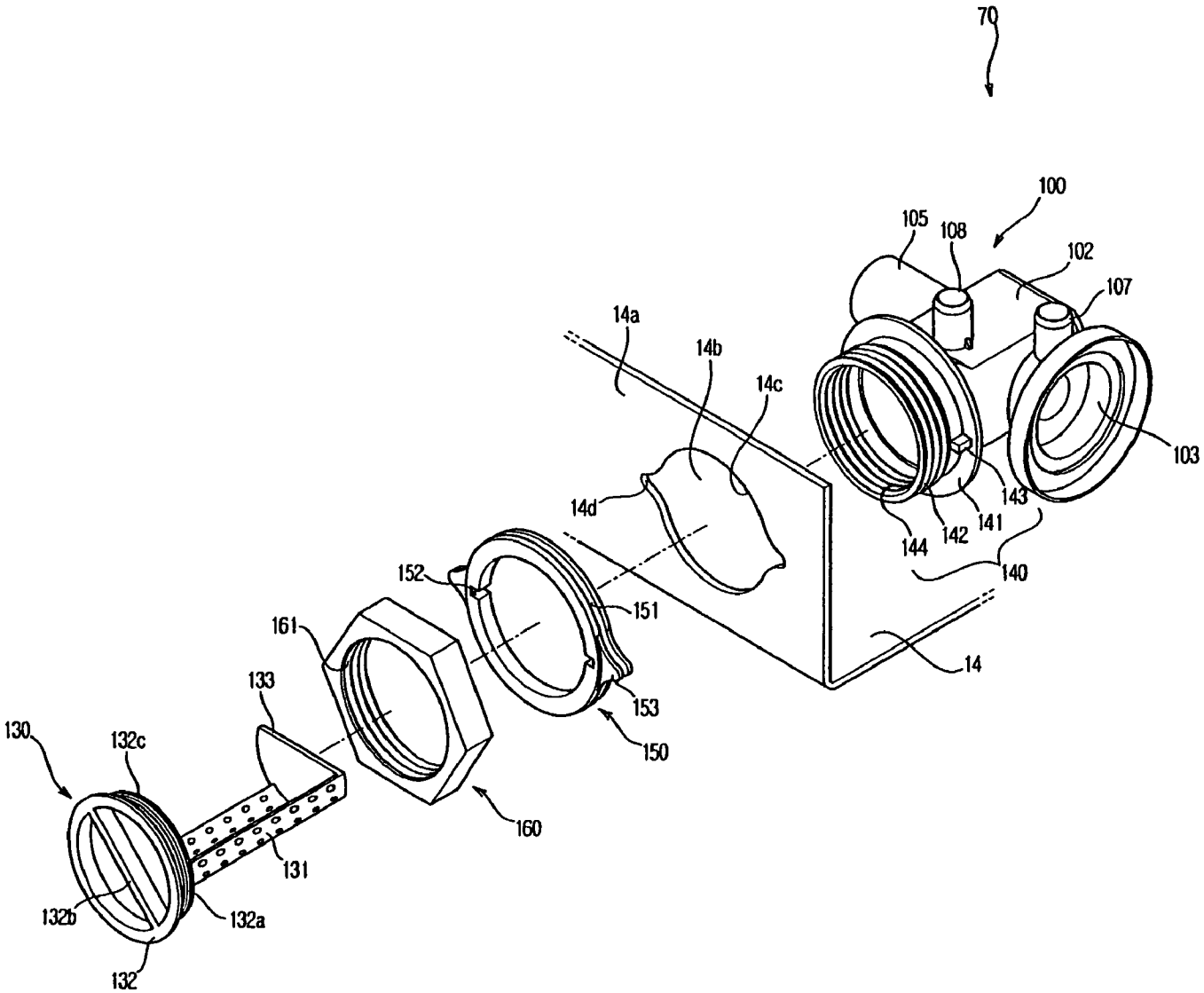
FIG. 3 is an exploded perspective view of a drain pump of a washing machine in accordance with the first embodiment of the present invention.
Figure 4:
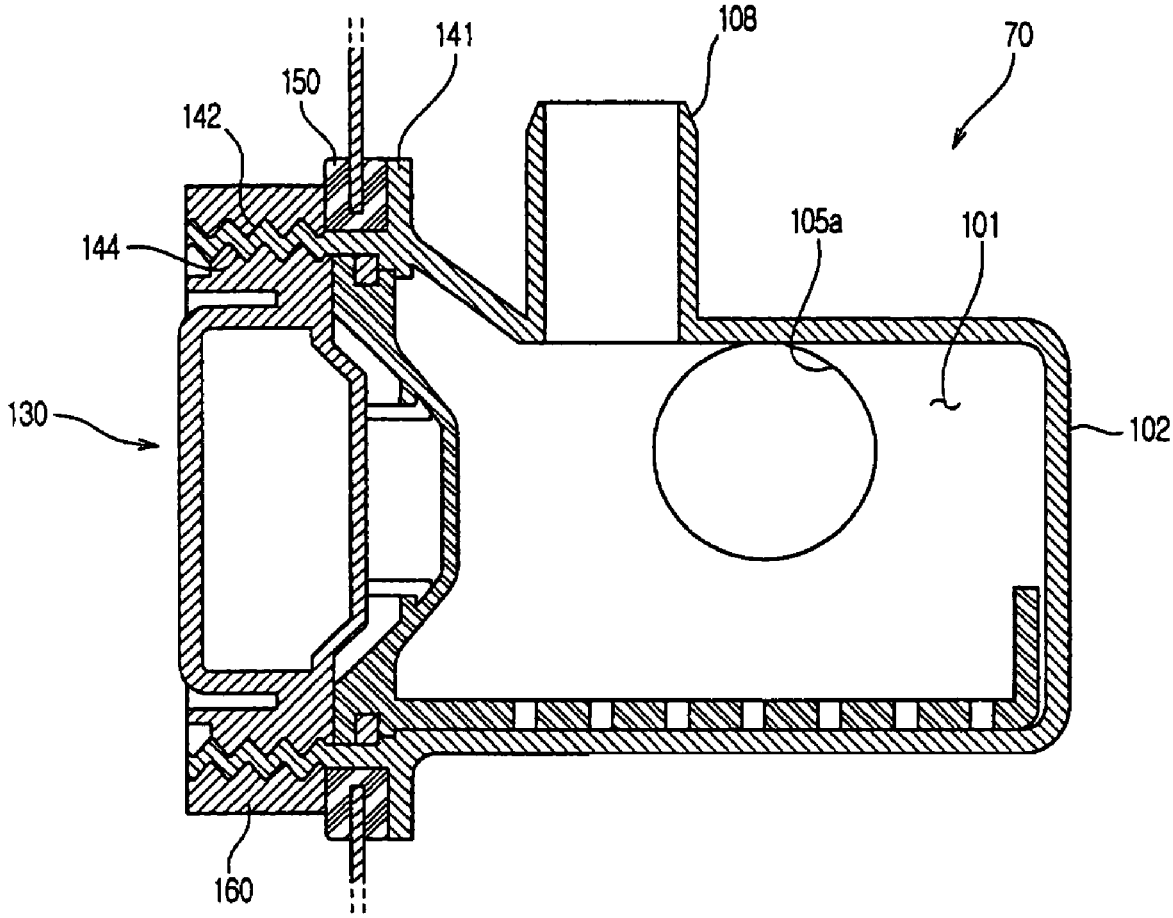
FIG. 4 is a sectional view of the drain pump and a drain filter taken along the line A-A' of FIG. 2 according to the first embodiment of the present invention.
Figure 5:
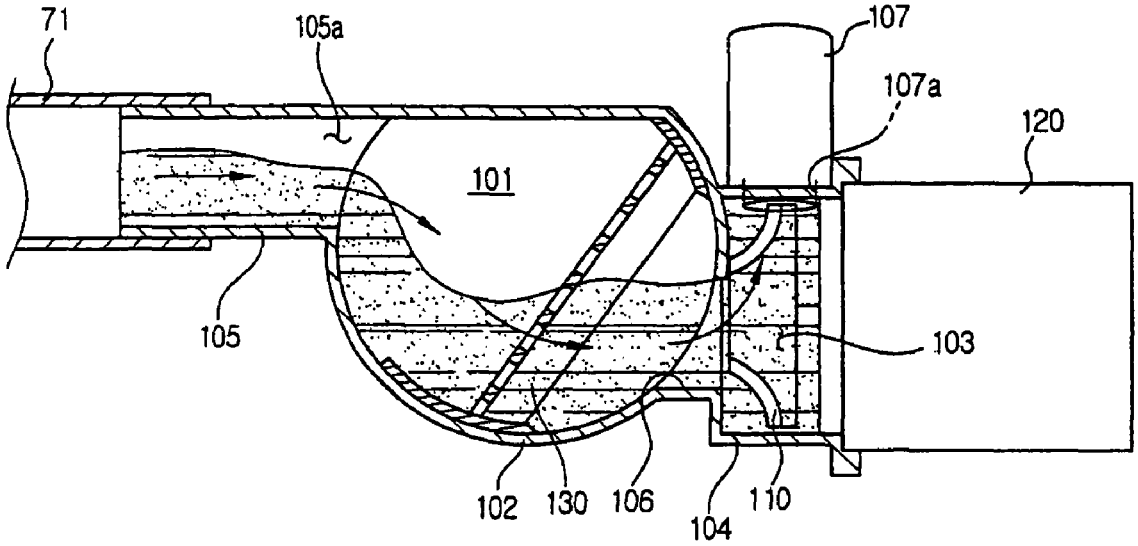
FIG. 5 is a sectional view of the drain pump and the drain filter taken along the line B-B' of FIG. 2 according to the first embodiment of the present invention.

FIG. 3 is an exploded perspective view of a drain pump of a washing machine in accordance with one embodiment of the present invention, FIG. 4 is a sectional view taken along the line A-A' of FIG. 2, and FIG. 5 is a sectional view taken along the line B-B' of FIG. 2.

As shown in FIGS. 3, 4, and 5, the drain pump 70 includes a drain casing 100 forming the external appearance of the drain pump 70 and having an internal space, into which water flows, an impeller 110 rotatably installed in the drain casing 100 forcibly discharging the water from the tub 20 to the outside of the washing machine, a pump motor 120 installed behind the impeller 110 providing driving force to the impeller 110, and a drain filter 130 detachably attached to the drain casing 100 filtering out impurities contained in the water supplied to the drain casing 100. The drain pump 70 further includes an anti-vibration member 150 absorbing the vibration of the drain pump 70, and a fixing member 160 fixing the drain pump 70 to the cabinet 10.

The drain casing 100 includes a filter case 102 with a filter chamber 101 defined therein, and a pump case 104 having a pump chamber 103 defined therein, wherein the filter case 102 is integrally formed with the pump case 104. The filter chamber 101 and the pump chamber 103 are divided from each other.

The filter chamber 101 is hollow such that the drain filter 130 is able to be put into and taken out of the filter chamber 101. The impeller 110 forcibly circulating the water is rotatably installed in the pump chamber 103.

A supply pipe 105 provided with an inlet 105*a* is connected to one side surface of the filter case 102 so that the water is supplied to the inside of the filter chamber 101, and a discharge hole 106 is formed through the other side surface of the filter case 102 corresponding to the inlet 105*a* so that the water, from which impurities are removed through the drain filter 130 installed in the filter chamber 101, is discharged to the pump chamber 103. A discharge pipe 107, provided with an outlet 107*a* discharging the water supplied to the pump chamber 103 through the discharge hole 106 to the outside of the pump chamber 103 by the impeller 110, is formed through an upper surface of the pump case 104.

The first drain pipe 71 connecting the tub 20 and the drain pump 70 is connected to the supply pipe 105, and the second drain pipe 72 extended to the outside of the cabinet 10 to discharge the water from the drain pump 70 to the outside of the drain pump 70 is connected to the discharge pipe 107.

An air hole 108 preventing the deterioration of the performance of the impeller 110 due to air supplied with the supplied water is formed through an upper surface of the filter case 102. Accordingly, the air hole 108 discharges the air in the drain casing 100 to the outside of the drain casing 100.

An opening is formed through a side surface of the pump case 104 forming the pump chamber 103, to which the pump motor 120 is installed. The opening of the surface of the pump case 104 is closed by installing the pump motor 120 thereto.

In the drain pump 70 having the above configuration, the drain filter 130 in the filter chamber 101 filters out impurities from the water, which is supplied from the tub 20 to the filter chamber 101. Then, the water flows towards the pump chamber 103. The impeller 110, which is rotated by the pump motor 120, discharges the water in the pump chamber 103 to the discharge pipe 107 of the pump chamber 103, thus draining the washing water in the tub 20 to the outside of the tub 20.

The drain casing 100 further includes the connection unit 140 that protrudes forward from the filter case 102.

The connection unit 140 has a hollow cylindrical shape and is provided with an open front surface portion. The connection unit 140 has designated length and diameter so that the connection unit 140 passes through the through hole 14*b* of the front portion 14*a* of the lower frame 14 and protrudes forward.

A ring-shaped protruding portion 141, which has a diameter larger than that of the through hole 14*b*, is formed along the outer cylindrical surface of the rear end of the connection unit 140. The protruding portion 141 contacts the inner surface of the anti-vibration member 150 connected to a circumferential surface 14*c* of the through hole 14*b*, thus supporting the drain pump 70. Fixing protrusions 143 maintaining the horizontal position of the drain pump 70 are formed on the protruding portion 141.

A first screw thread 142 is formed on the outer circumferential surface of the front end of the connection unit 140 in the direction of the protruding portion 141. The first screw thread 142 is engaged with a second screw thread 161 formed on the inner circumferential surface of the fixing member 160, which will be described later, thereby allowing the fixing member 160 to be screw-connected with the connection unit 140.

A third screw thread 144 is formed on the inner circumferential surface of the connection unit 140. The third screw thread 144 is engaged with a fourth screw thread 132*a* of the drain filter 130, which will be described later, thus allowing the drain filter 130 to be screw-connected with the connection unit 140.

The drain filter 130 includes a filter member 131 filtering out impurities from the water, a hand grip 132 connected to the front end of the filter member 131 to insert and remove the filter member 131 into and from the drain casing 100, and a guide panel 133 connected to the rear end of the filter member 131 guiding insertion of the filter member 131 into the drain casing 100 such that the filter member 131 is correctly set into the opening of the connection unit 140 of the drain casing 100.

The hand grip 132 has a cylindrical shape corresponding to the inner circumferential surface of the connection unit 140. The hand grip 132 includes the fourth screw thread 132*a* formed on the outer circumferential surface of the hand grip 132 to be engaged with the third screw thread 144 formed on the inner circumferential surface of the connection unit 140, a protruding knob 132*b* to rotate the hand grip 132, and a sealing member 132*c* preventing the water in the filter case 102 from being discharged to the opening of the connection unit 140.

Accordingly, when the knob 132*b* of the hand grip 132 is rotated in one direction after the drain filter 130 is inserted into the filter chamber 101 through the opening of the connection unit 140, the hand grip 132 is correspondingly rotated. Thereby, the fourth screw thread 132*a* is engaged with the third screw thread 144, and the sealing member 132*c* is fixedly pressed onto the inner circumferential surface of the filter case 102. When the knob 132*b* of the hand grip 132 is rotated in the reverse direction and the hand grip 132 is correspondingly rotated in the reverse direction, the drain filter 130 is separated from the drain casing 100.

The anti-vibration member 150 may be made of an elastic material, which can absorb vibration. A connection groove 151 is formed in the outer circumferential surface of the anti-vibration member 150 so that the circumferential surface 14*c* of the through hole 14*b* of the front portion 14*a* is able to be inserted into the connection groove 151.

Fixing grooves 152, into which the fixing protrusions 143 of the connection unit 140 are inserted, are formed in the inner circumferential surface of the anti-vibration member 150 at positions corresponding to the fixing protrusions 143. When the anti-vibration member 150 is attached to the front portion 14*a* of the lower frame 14 by inserting the circumferential surface 14*c* of the through hole 14*b* into the connection groove 151, the connection unit 140 of the drain casing 100 is inserted into the anti-vibration member 150 and the fixing member 160 is connected to the anti-vibration member 150. The rear surface of the fixing member 160 therefore contacts the front surface of the anti-vibration member 150, abutting the front surface of the anti-vibration member 150. Thereby, the anti-vibration member 150 is rotated together with the rotation of the fixing member 160. Then, the fixing protrusions 143 connected to the fixing grooves 152 of the anti-vibration member 150 are also rotated, and the drain pump 70 is rotated.

In order to further maintain the anti-vibration member 150 in position, fixing portions 153 are protruded from the outer circumferential surface of the anti-vibration member 150 at positions corresponding to the fixing grooves 152 in the radial direction. Grooves 14*d* corresponding to the fixing portions 153 are formed in the through hole 14*b* of the front portion 14*a* of the lower frame 14. Therefore, when the anti-vibration member 150 is connected to the circumferential surface 14*c* of the through hole 14*b*, it is possible to prevent the rotation of the anti-vibration member 150, even when the fixing member 160 is rotated. That is, the fixing portions 153 of the anti-vibration member 150 are inserted into the grooves 14*d* of the through hole 14*b*, thus maintaining the horizontal position of the drain pump 70. Therefore, it is possible to prevent the rotation of the anti-vibration member 150 due to the rotation of the fixing member 160.

The drain pump 70 of the washing machine of the first embodiment of the present invention includes the fixing member 160 fixing the position of the drain pump 70. The fixing member 160 has a circular hollow formed therein, and the second screw thread 161 is formed on the inner circumferential surface of the fixing member 160 such that the second screw thread 161 can be engaged with the first screw thread 142 formed on the outer circumferential surface of the connection unit 140. The outer circumferential surface of the fixing member 160 may have, for example, a polygonal shape. A user can therefore easily rotate the fixing member 160 so as to press the anti-vibration member 150 between the protruding portion 141 and the fixing member 160 onto the circumferential surface 14*c* of the through hole 14*b*, thereby firmly fixing the drain pump 70 to the front portion 14*a* of the lower frame 14.

Hereinafter, a fixing structure of the above-described drain pump of the washing machine of the first embodiment of the present invention will be described.

First, the anti-vibration member 150 is firmly connected to the circumferential surface 14*c* of the through hole 14*b*, and the connection unit 140 of the drain casing 100 is inserted into the anti-vibration member 150 so that the connection unit 140 protrudes forward from the anti-vibration member 150. The fixing protrusions 143 of the connection unit 140 are inserted into the fixing grooves 152 of the anti-vibration member 150, thus maintaining the horizontal position of the drain pump 70. Thereafter, the second screw thread 161 of the fixing member 160 is engaged with the first screw thread 142 of the connection unit 140, thus assembling the drain pump 70 with the front portion 14*a* of the lower frame 14, and causing the anti-vibration member 150, disposed between the connection unit 140 and the circumferential surface 14*c* of the through hole 14*b*, to prevent contact between the connection unit 140 and the cabinet 10. Therefore, the vibration of the drain pump 70 is prevented from being transferred to the cabinet 10. Accordingly, the cabinet 10 is not vibrated because of the drain pump 70.

Hereinafter, a drain pump of a washing machine in accordance with another embodiment of the present invention will be described. Some parts in this embodiment, which are substantially the same as those in the first embodiment, are denoted by the same reference numerals even through they are depicted in different drawings, and a detailed description thereof will thus be omitted.

Figure 6:
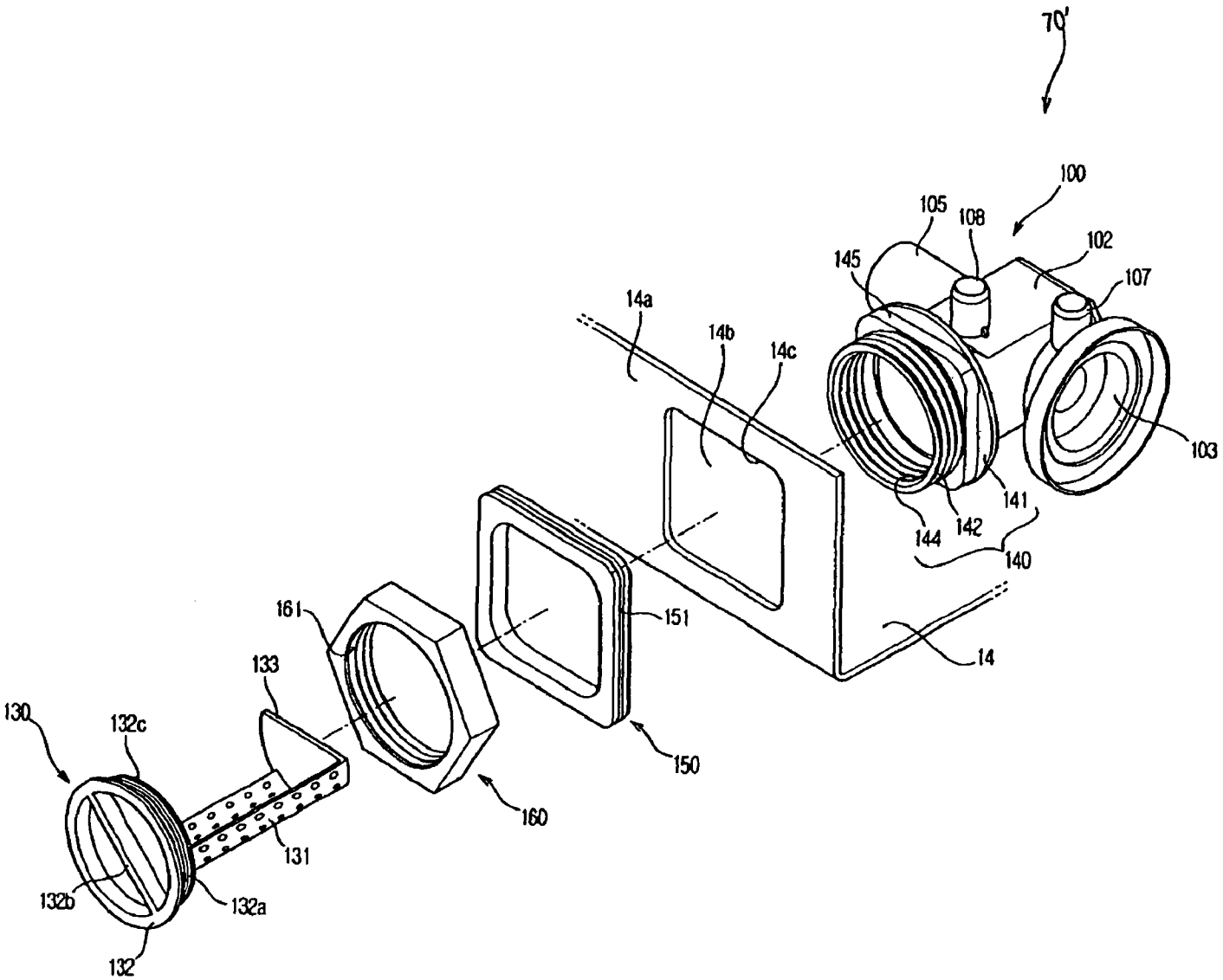
FIG. 6 is an exploded perspective view of a drain pump of a washing machine in accordance with a second embodiment of the present invention.

FIG. 6 is an exploded perspective view of a drain pump of a washing machine in accordance with another embodiment of the present invention.

The through hole 14*b* of the front portion 14*a* may have a shape other than a circular shape, i.e., a polygonal shape or an oval shape, and the anti-vibration member 150 may have a shape corresponding to the shape of the through hole 14*b*. Thus, the anti-vibration member 150 is able to be fitted to the circumferential surface 14*c* of the through hole 14*b*. The connection unit 140 of the drain casing 100 includes an insertion portion 145 formed between the protruding portion 141 and the first screw thread 142 of the connection unit 140. The insertion portion 145 has a shape corresponding to the shape of the inner circumferential surface of the anti-vibration member 150 so that the insertion portion 145 is fitted into the anti-vibration member 150.

Accordingly, in a manner different from the first embodiment, the drain pump 70' of this embodiment does not require fixing portions and grooves preventing the rotation of the anti-vibration member 150, and is easily fixed to the cabinet 10 without fixing grooves and fixing protrusions used to maintain the horizontal position of the drain pump 70'.

Hereinafter, a drain pump of a washing machine in accordance with an additional embodiment of the present invention will be described.

Figure 7:
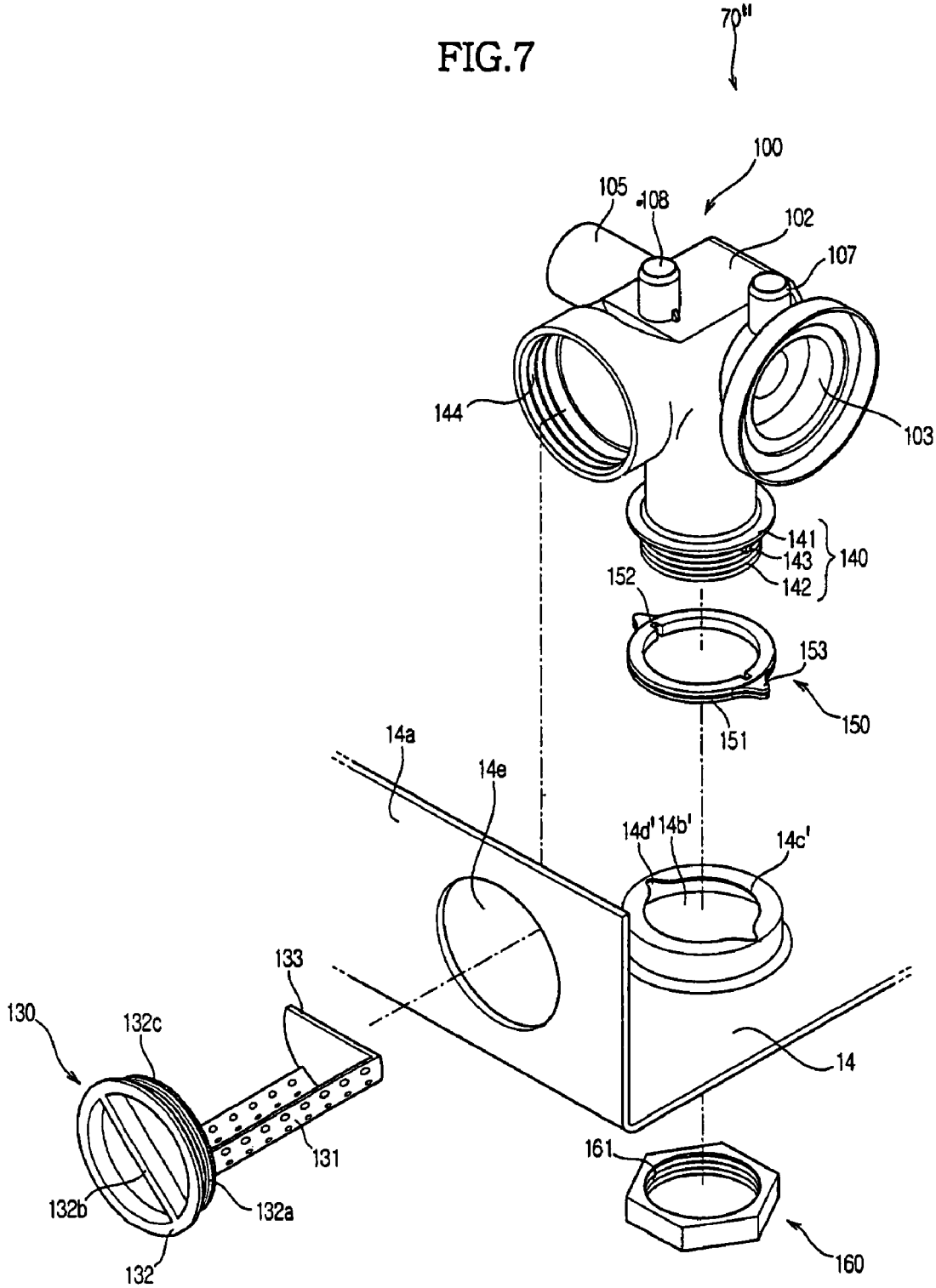
FIG. 7 is an exploded perspective view of a drain pump of a washing machine in accordance with a third embodiment of the present invention.

FIG. 7 is an exploded perspective view of a drain pump of a washing machine in accordance with the additional embodiment of the present invention.

The connection unit 140 of the drain pump 70" of this embodiment is formed on a lower portion of the drain casing 100, and the through hole 14*b*, through which the connection 140 passes, is formed through the lower frame 14.

An opening to install the drain filter 130 in the filter chamber 101 is formed through the filter case 102. The third screw thread 144 is formed on the inner circumferential surface of the opening and corresponds with the fourth screw thread 132*a* of the drain filter 130 to insert and remove the drain filter 130 into and from the filter case 102.

A filter hole 14*e* exposing the opening of the filter case 102 and the hand grip 132 of the drain filter 130 to the outside is formed through the front portion 14*a* of the lower frame 14 so that a user can separate the drain filter 130 from the filter case 102 through the filter hole 14*e* in order to wash the drain filter 130. The filter hole 14*e* of the front portion 14*a* has a diameter large enough to allow the filter member 131, guide panel 133, the sealing member 132*c* and the fourth screw thread 132*a* of the drain filter 130 to pass through the filter hole 14*e*. The filter case 102 is separated from the front portion 14*a* of the lower frame 14 so that the vibration of the drain pump 70 is not transferred to the cabinet 10.

The fixing grooves 152 and the fixing portions 153 of the anti-vibration member 150 and the fixing protrusions 143 of the connection unit 140 of this embodiment, which are the same as those of the first embodiment, prevent the rotation of the drain pump 70 so that the opening of the filter case 102 is coaxial with the filter hole 14*e*.

A through hole 14*b*', similar to that of the through hole 14*b* of the first embodiment, is formed through the lower frame 14. The through hole 14*b*' includes a circumferential surface 14*c*' which is able to be inserted into the connection groove 151 of the anti-vibration member 150. Fixing portions 153 of the anti-vibration member 150 are inserted into the grooves 14*d*' of the through hole 14*b*' formed in the lower frame 14, thus maintaining the position of the drain pump 70". When the drain pump 70" is assembled, the fixing member 160 abuts a lower portion of the anti-vibration member 150.

As apparent from the above description, an embodiment of the present invention provides a washing machine having a drain pump, in which an anti-vibration member is provided between a circumferential surface of a through hole of a front portion of a lower frame and a connection unit, thus preventing the vibration of the drain pump from being transferred to a cabinet.

Further, a fixing member and the connection unit are screw-connected, thus simplifying a fixing structure of the drain pump and increasing efficiency of an assembly process as well as preventing the vibration of the drain pump.

Although embodiments of the invention have been shown and described, it would be appreciated by those skilled in the art that changes may be made in these embodiments without departing from the principles and spirit of the invention, the scope of which is defined in the claims and their equivalents.

What is claimed is:

1. A washing machine, comprising:

a cabinet forming an external portion of the washing machine and having a through hole defined through a portion of the cabinet; and a drain pump installed on the cabinet, the drain pump comprising:

a connection unit having one end passing through the through hole and protruding to an outside of the cabinet, an anti-vibration member affixed in the through hole to absorb the vibration of the drain pump, and a fixing member connected with the connection unit and pressing the anti-vibration member, wherein the anti-vibration member is arranged to surround a circumferential surface of the through hole so that the connection unit and the fixing member do not contact the cabinet by the anti-vibration member, thus preventing vibration caused by the drain pump from being transferred to the cabinet.

2. The washing machine according to claim 1, further comprising a connection groove formed in the anti-vibration member, fittingly affixing the anti-vibration member to the lower frame within the through hole.

3. The washing machine according to claim 1, further comprising a protruding portion formed on the connection unit so that the drain pump is supported by an end of the anti-vibration member.

4. The washing machine according to claim 3, wherein the anti-vibration member is pressed by the protruding portion and the fixing member.

5. The washing machine according to claim 1, wherein the anti-vibration member has a ring shape and the through hole has a circular shape such that the anti-vibration member is fittingly affixed to the through hole.

6. The washing machine according to claim 1, further comprising a first screw thread formed on an outer circumferential surface of the connection unit, and a second screw thread formed on an inner circumferential surface of the fixing member and engagable with the first screw thread.

7. The washing machine according to claim 1, wherein the anti-vibration member includes fixing grooves formed on an inner circumferential surface of the anti-vibration member fixing a position of the drain pump when the drain pump is installed on the cabinet, and the connection unit includes fixing protrusions formed therein connected to the fixing grooves.

8. The washing machine according to claim 1, further comprising fixing portions formed on an outer circumferential surface of the anti-vibration member maintaining a horizontal position of the drain pump and preventing rotation of the anti-vibration member due to rotation of the fixing member.

9. The washing machine according to claim 1, wherein the drain pump further comprises a drain filter to filter impurities contained in water supplied to the drain pump.

10. The washing machine according to claim 9, wherein the drain filter is insertable into and removable out of the cabinet through the through hole.

11. The washing machine according to claim 9, further comprising a third screw thread formed on an inner circumferential surface of the connection unit, and a fourth screw thread formed on an outer circumferential surface of the drain filter and engagable with the third screw thread, so that the drain pump and the drain filter are screw-connected.

12. The washing machine according to claim 1, wherein the connection unit is formed on a lower portion of the drain pump.

13. The washing machine according to claim 9, wherein a filter hole allowing the drain filter to be inserted into and removed from the cabinet is defined through the cabinet.

14. A washing machine, comprising:

a cabinet forming an external portion of the washing machine and having a through hole defined therethrough; and a drain pump installed on the cabinet, the drain pump comprising:

a connection unit provided with one end protruded to an outside of the cabinet, an anti-vibration member provided between the through hole and a portion of the connection unit to absorb a vibration of the drain pump, and a fixing member connectable to the connection unit to fix the drain pump to the cabinet, wherein the anti-vibration member is arranged to surround a circumferential surface of the through hole so that the connection unit and the fixing member do not contact the cabinet by the anti-vibration member, thus preventing vibration caused by the drain pump from being transferred to the cabinet.

15. The washing machine according to claim 14, wherein the drain pump further comprises a drain filter to filter impurities contained in water supplied to the drain pump.

16. The washing machine according to claim 15, wherein the through hole is formed through a front surface of the cabinet, and the drain filter is inserted into and removed from the cabinet through the through hole.

17. The washing machine according to claim 15, further comprising a filter hole formed through the cabinet and allowing the drain filter to be inserted into and removed from the cabinet, wherein the through hole is formed through a lower surface of the cabinet.

* * * * *